US007922601B2

(12) United States Patent
Ban et al.

(10) Patent No.: US 7,922,601 B2
(45) Date of Patent: Apr. 12, 2011

(54) GOLF CLUB HEAD

(75) Inventors: Wataru Ban, Chichibu (JP); Fumiaki Sato, Chichibu (JP); Kozue Wada, Chichibu (JP)

(73) Assignee: Bridgestone Sports Co., Ltd, Tokyo (JP)

( * ) Notice: Subject to any disclaimer, the term of this patent is extended or adjusted under 35 U.S.C. 154(b) by 0 days.

(21) Appl. No.: 12/355,326

(22) Filed: Jan. 16, 2009

(65) Prior Publication Data

US 2010/0056295 A1 Mar. 4, 2010

(30) Foreign Application Priority Data

Sep. 3, 2008 (JP) ..... 2008-226310

(51) Int. Cl.
*A63B 53/04* (2006.01)

(52) U.S. Cl. ..... 473/330; 473/331

(58) Field of Classification Search ..... 473/324–350; D21/750

See application file for complete search history.

(56) References Cited

U.S. PATENT DOCUMENTS

| | | | | |
|---|---|---|---|---|
| 5,029,864 | A * | 7/1991 | Keener | 473/331 |
| 5,618,239 | A * | 4/1997 | Rife | 473/330 |
| 5,755,626 | A * | 5/1998 | Shira | 473/330 |
| 5,785,610 | A * | 7/1998 | Birmingham | 473/331 |
| 6,183,379 | B1 * | 2/2001 | Kim et al. | 473/325 |
| 7,014,568 | B2 * | 3/2006 | Pelz | 473/287 |
| 7,056,226 | B2 * | 6/2006 | Kennedy | 473/330 |
| 7,568,983 | B2 * | 8/2009 | Gilbert | 473/330 |
| 2002/0049095 | A1 * | 4/2002 | Galloway et al. | 473/330 |
| 2008/0171613 | A1 * | 7/2008 | Gilbert et al. | 473/331 |

FOREIGN PATENT DOCUMENTS

JP 10-248974 A 9/1998

* cited by examiner

*Primary Examiner* — Sebastiano Passaniti

(74) *Attorney, Agent, or Firm* — Paul, Hastings, Janofsky & Walker LLP

(57) ABSTRACT

A golf club head according to the present invention comprises a plurality of score lines on a face, and a stair-shaped portion comprising a plurality of steps formed on a side wall of the score line from a face side end of the side wall in a depth direction of the score line.

12 Claims, 7 Drawing Sheets

FIG. 6

| | SPECIFICATIONS OF SCORE LINES | | | | | | | | TEST RESULTS | | | CONFORMANCE TO TWO-CIRCLE RULE |
|---|---|---|---|---|---|---|---|---|---|---|---|---|
| | ANGLE θa (°) | ANGLE θb (°) | ANGLE θb' (°) | WIDTH W (mm) | DEPTH D (mm) | AREA Ds (mm) | AREA Ds' (mm) | PITCH P (mm) | BACKSPIN AMOUNT (rpm) | | PERCENTAGE OF DECREASE (%) | |
| | | | | | | | | | FAIRWAY | ROUGH | | |
| COMPARATIVE EXAMPLE 1 | 70 | – | – | 0.85 | 0.50 | – | – | 3.6 | 11493 | 3997 | −65.2 | NG |
| COMPARATIVE EXAMPLE 2 | 67 | – | 48 | 0.89 | | – | 0.16 | | 11626 | 3324 | −71.4 | OK |
| EXAMPLE | | 48 | – | | | 0.16 | – | | 11505 | 4372 | −62.0 | OK |

GOLF CLUB HEAD

BACKGROUND OF THE INVENTION

1. Field of the Invention

The present invention relates to a golf club head and, more particularly, to score lines on the face.

2. Description of the Related Art

Generally, on the face of a golf club head, a plurality of straight grooves are formed parallel to each other in the toe-and-heel direction (e.g., Japanese Patent Laid-Open No. 10-248974). These grooves are called score lines, marking lines, face lines, or the like (to be referred to as score lines in this specification). These score lines have an effect of increasing the backspin amount of a shot.

Generally, compared to a shot from fairway, grass gets in between the face and a golf ball and the backspin amount of a shot decreases in the case of a shot from the rough. Therefore, it is desired to suppress a significant decrease in the backspin amount of a shot in the case of a shot from the rough.

SUMMARY OF THE INVENTION

It is an object of the present invention to provide a golf club head which suppresses a significant decrease in the backspin amount of a shot in the case of a shot from the rough.

According to the present invention, there is provided a golf club head comprising a plurality of score lines on a face, and a stair-shaped portion comprising a plurality of steps arranged on a side wall of said score line from a face side end in a depth direction of said score line.

Further features of the present invention will become apparent from the following description of exemplary embodiments (with reference to the attached drawings).

BRIEF DESCRIPTION OF THE DRAWINGS

FIG. 6 is a table showing the specifications of score lines of Comparative Examples 1 and 2 and an example, the test results, and the conformance to the two-circle rule.

DESCRIPTION OF THE EMBODIMENTS

Figure 1:
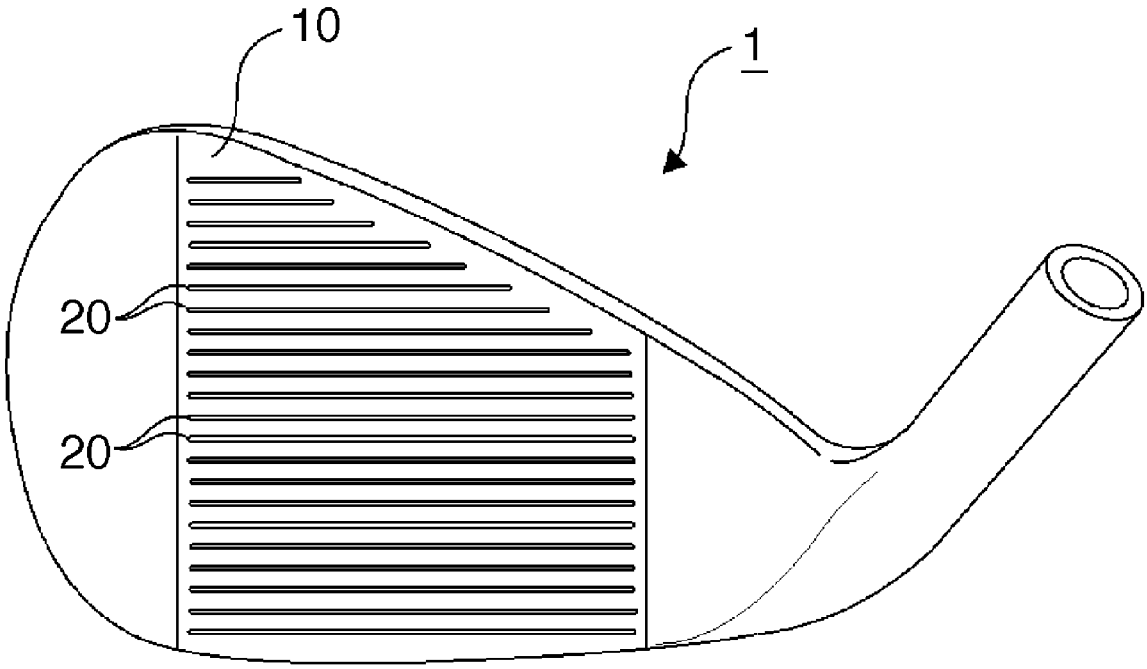
FIG. 1 is a view showing the outer appearance of a golf club head 1 according an embodiment of the present invention.

FIG. 1 is a view showing the outer appearance of a golf club head 1 according to an embodiment of the present invention. FIG. 1 shows an example in which the present invention is applied to an iron golf club head. The present invention is suitable for iron golf club heads, and particularly for middle iron golf club heads, short iron golf club heads, and wedge golf club heads. More specifically, the present invention is suitable for golf club heads with loft angles of 25° to 70° (both inclusive) and head weights of 240 g to 320 g (both inclusive). However, the present invention is also applicable to wood or utility (hybrid) golf club heads.

The golf club head 1 has a plurality of score lines 20 formed on its face (hitting surface) 10. The respective score lines 20 are straight grooves extending in the toe-and-heel direction and parallel to each other. In this embodiment, the respective score lines 20 are arranged at an equal interval (equal pitch) but they may be arranged at different intervals.

Figure 2:
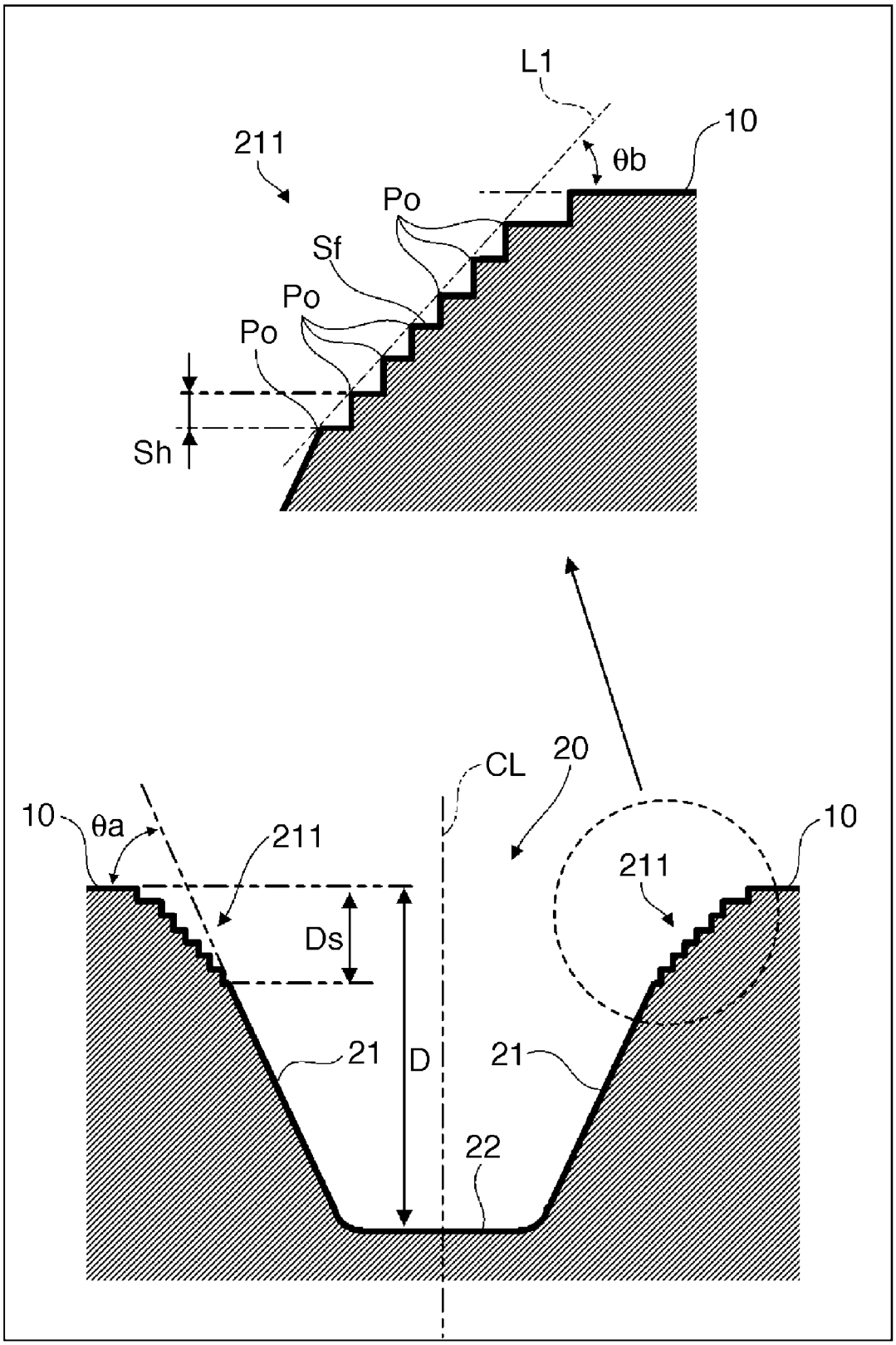
FIG. 2 shows a sectional view of a score line 20 in a direction perpendicular to the longitudinal direction (toe-and-heel direction) and its partially enlarged view.

FIG. 2 shows a sectional view of the score line 20 in a direction perpendicular to the longitudinal direction (toe-and-heel direction) and its partially enlarged view (an enlarged view of a stair-shaped portion 211). In this embodiment, the cross-sectional shapes of the score lines 20 are the same except in two end portions in the longitudinal direction. The score lines 20 have the same cross-sectional shape.

The score line 20 has a pair of side walls 21 and a bottom wall 22. The cross-sectional shape of the score line 20 is symmetric with regard to its center line CL. In this embodiment, the cross-sectional shape of the score line 20 is almost trapezoidal, but it may be a V-shape or U-shape. A depth D is the length from the face 10 to the bottom wall 22.

The side wall 21 has the stair-shaped portion 211 including a plurality of steps arranged from the end of the side wall 21 on the face 10 side in the depth direction of the score line 20. The number of steps of the stair-shaped portion 211 is seven in this embodiment, but the number of steps can be two or more.

Since the stair-shaped portion 211 is formed, a plurality of edges Po is formed in the periphery of the boundary portion of the score line 20 and face 10. Upon hitting a golf ball, since these edges Po touch the golf ball, its backspin amount can be increased. Particularly, in the case of a shot from the rough, even when grass gets in between the face 10 and a golf ball, the presence of a plurality of the edges Po improves the frictional force with respect to the golf ball. Accordingly, it is possible to suppress a significant decrease in the backspin amount.

In this embodiment, a plurality of the edges Po is positioned on a straight line L1. However, it is possible to employ an arrangement in which the edges Po are not positioned on a common straight line. An angle θb is the angle between the straight line L1 and face 10. An angle θa is the angle between the face 10 and a portion of the side wall 21 without the stair-shaped portion 211.

In this embodiment, a surface Sf of each step of the stair-shaped portion 211 is parallel to the face 10, but it may not be parallel to the face 10. However, the stair-shaped portion 211 is processed more easily when the surface Sf is set to be parallel to the face 10.

The larger a step difference Sh of each step of the stair-shaped portion 211, the larger an amount by which a golf ball is caught by each step upon hitting, and the backspin amount increases. However, when the step difference Sh exceeds a certain size, an amount by which a golf ball is caught does not change any longer. On the contrary, it may take time to form the steps depending on the processing method. Accordingly, the step difference Sh is preferably 30 μm or less. In this embodiment, the step difference Sh is the same in all steps, but it may differ in the respective steps.

An area Ds indicates the area of the stair-shaped portion 211 in the depth direction of the score line 20, which is the length from the face 10 to the deepest step of the stair-shaped portion 211. The area Ds is preferably ½ or less of a depth D of the score line 20, and more preferably ⅓ or less. Even if the area Ds is larger than ½ of the depth D, the number of the edges Po that touch a golf ball upon hitting does not largely change and a change in the backspin amount is small. On the contrary, since the number of steps of the stair-shaped portion 211 increases, it may take time to process the steps depending on the processing method. When the area Ds is set to ⅓ or less of the depth D, it is possible to reduce time required for processing the stair-shaped portion 211 while maintaining the effect of increasing the backspin amount.

The relationship between the rules about score lines of a golf club head for competitions and this embodiment will be described next. As a rule about score lines of a golf club head for competitions, it is determined that each edge of a score line must be positioned within a virtual circle with a radius of 0.011 inches concentric with a virtual circle with a radius of 0.010 inches which internally touches the side surface of the score line and the face (to be referred to as a two-circle rule, hereinafter). In order to make the golf club head of the present invention as a golf club head for competitions, score lines are designed to satisfy the two-circle rule.

Figure 3:
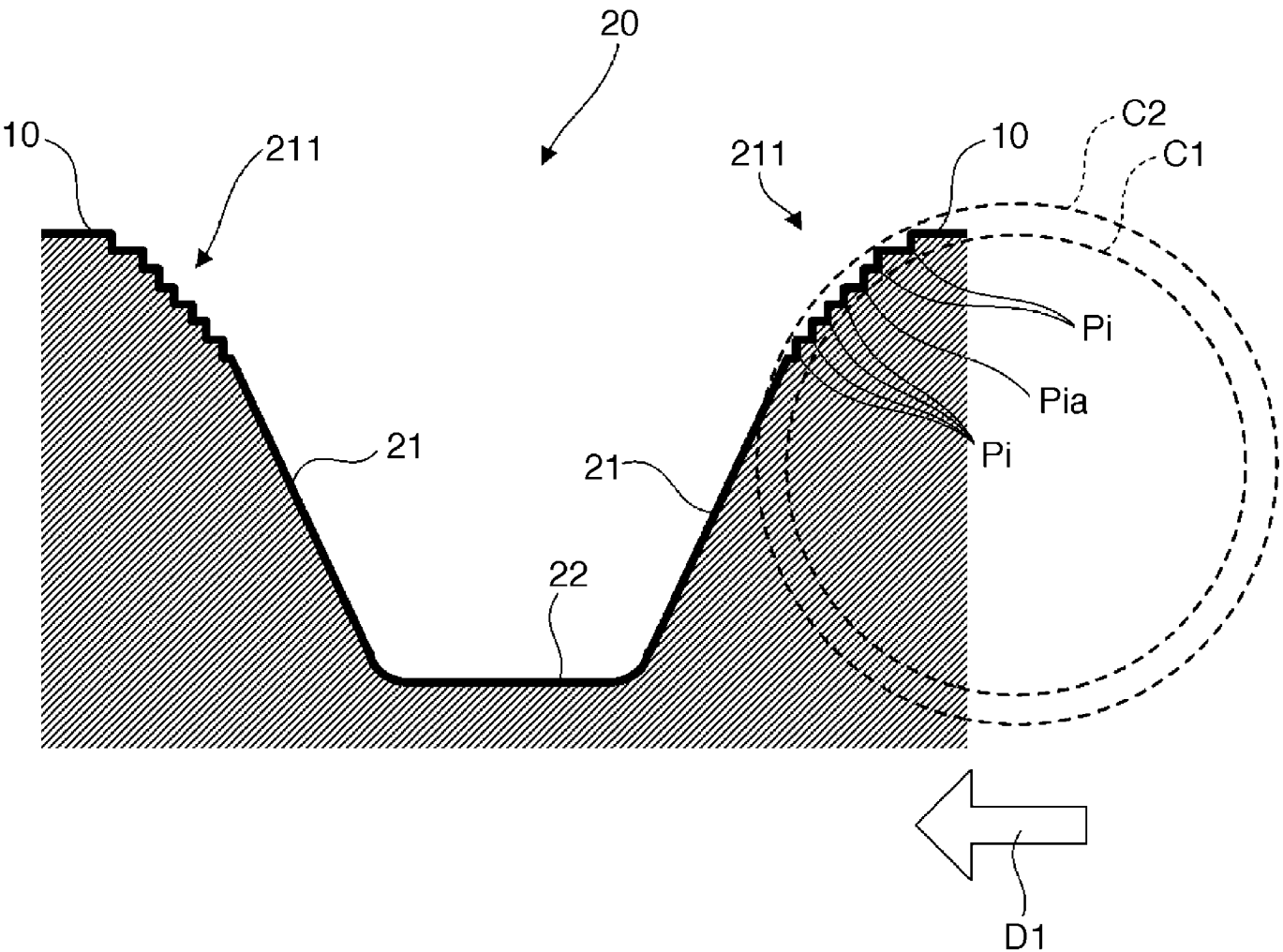
FIG. 3 is a view for explaining a two-circle rule.

FIG. 3 is a view for explaining the two-circle rule and shows an example in which the score line 20 is formed to satisfy the two-circle rule. A virtual circle C1 is a circle with a radius of 0.010 inches. The position of the virtual circle C1 is determined as follows. That is, assume that the virtual circle C1 is virtually moved in a direction (a direction indicated by an arrow D1) from a position away from the score line 20 to get close to the score line while the virtual circle C1 internally touches the face 10. The virtual circle C1 first touches any one of edges Pi each on the opposite side of the edge Po (see FIG. 2) of each step of the stair-shaped portion 211 or a portion of the side wall 21 without the stair-shaped portion 211. The example in FIG. 3 shows a case in which, of a plurality of edges Pi and a portion of the side wall 21 without the stair-shaped portion 211, the virtual circle C1 first touches an edge Pia.

A virtual circle C2 is an edge with a radius of 0.011 inches which is concentric with the virtual circle C1. In the example in FIG. 3, since the edge of the score line 20 (the boundary portion of the stair-shaped portion 211 and face 10) is positioned within the virtual circle C2, this example conforms to the two-circle rule.

In the case of a conventional golf club head without the stair-shaped portion 211, in order to satisfy the two-circle rule, it is necessary to decrease the angle between each side wall of the score lines and the face at the edge of the score line. In this case, the backspin amount decreases. In this embodiment, since the stair-shaped portion 211 is formed, it is possible to increase the backspin amount while conforming to the two-circle rule.

As another rule for score lines of a golf club head for competitions, it is determined that a width W and cross section area A of a score line and a distance S of adjacent score lines need to satisfy the cross section area $A(inch^2)/(W(inch)+S(inch))\leqq$(to be referred to as an area rule, hereinafter). The metric system expresses the cross section area $A(mm^2)/(W(mm)+S(mm))\leqq 0.0762$.

In order to make the golf club head of the present invention as a golf club head for competitions, score lines are designed to satisfy the area rule as well.

Figure 4:
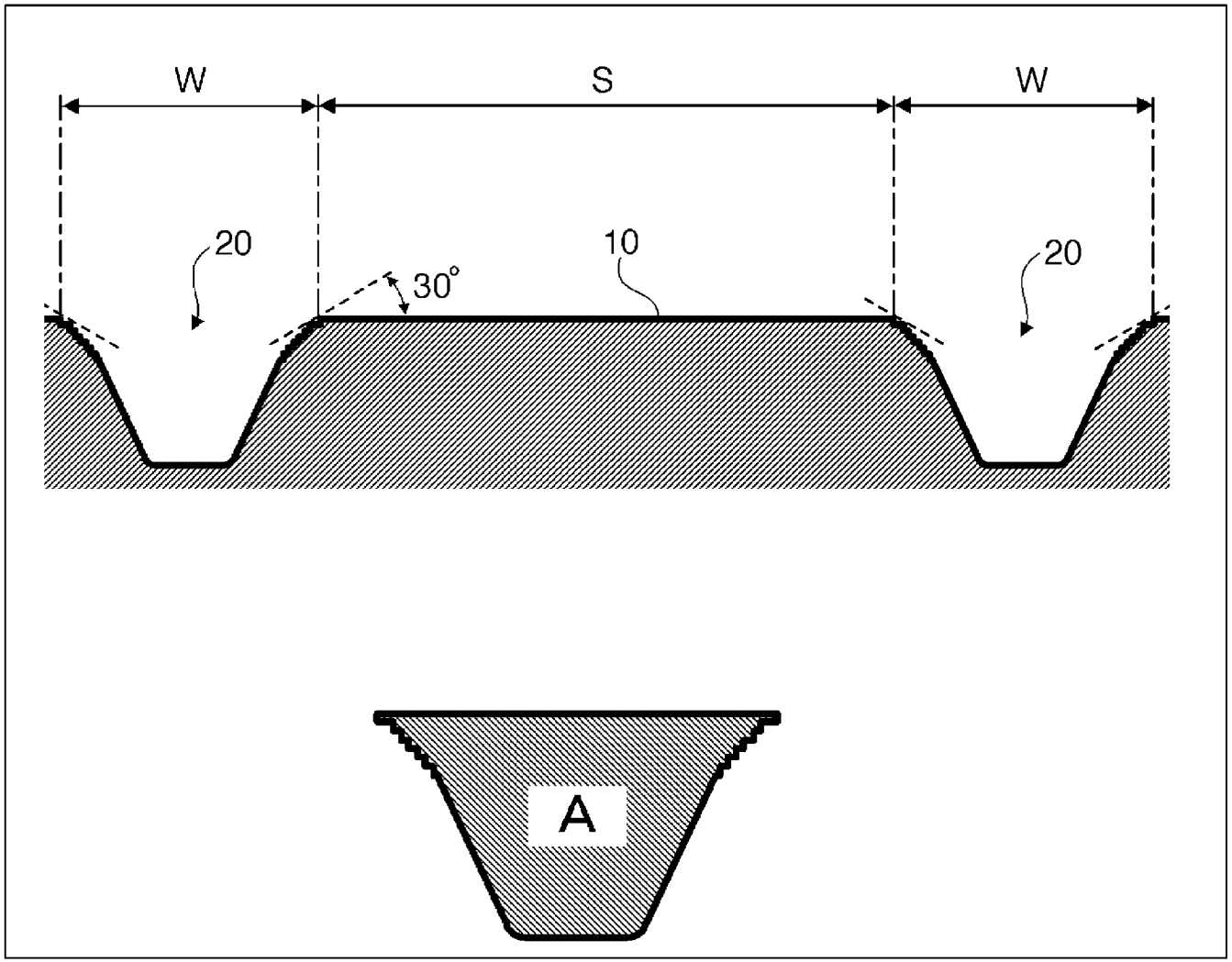
FIG. 4 is a view for explaining an area rule.

FIG. 4 is a view for explaining the area rule. The width W of the score line 20 indicates the width measured based on the so-called 30 degrees measurement rule. That is, the width W indicates the distance between the contact points of the respective virtual lines inclined at an angle of 30° with respect to the face 10 and the respective edges of the score line 20. The distance S between the score lines 20 indicates the distance between the contact points of the respective virtual lines inclined at an angle of 30° with respect to the face 10 and the respective edges of the score lines 20 adjacent to one another. The cross section area A indicates the cross-sectional area in a direction perpendicular to the longitudinal direction (toe-and-heel direction) of the score line 20.

The method of forming the score lines 20 will be described next. As the method of forming the score lines 20, cutting, forging, casting, or the like is available. The score lines 20 may be formed such that grooves without the stair-shaped portions 211 are formed by a first process and then the stair-shaped portions 211 are formed by a second process. In this case, the first process may be different from the second process. For example, the first process may be a forging process and the second process may be a cutting process. In any case, since the stair-shaped portion 211 includes fine steps, it is preferably formed by a cutting process.

Figure 5A:
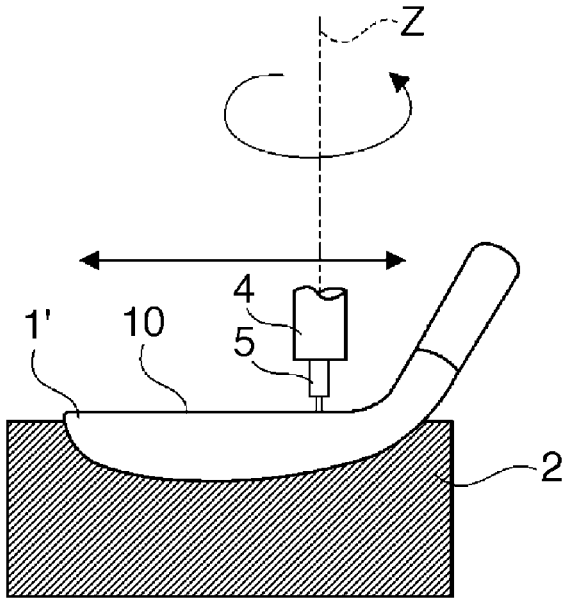
FIGS. 5A to 5C are views for explaining examples of the method of forming the score lines 20.
Figure 5B:
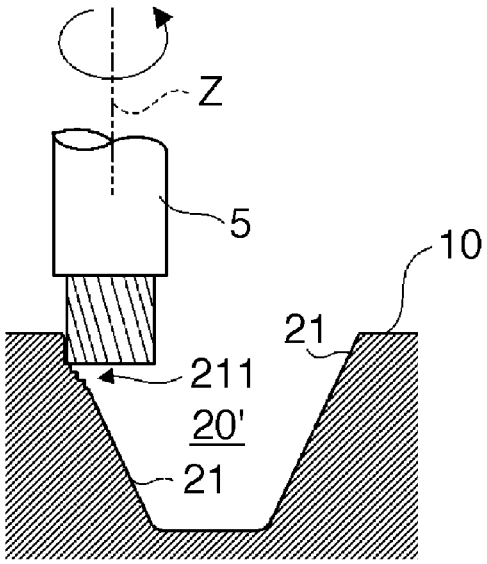
Figure 5C:
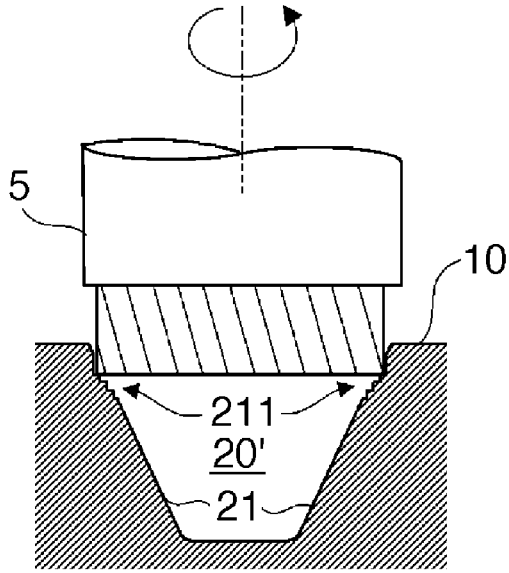

FIGS. 5A to 5C are views for explaining examples of the method of forming the score lines 20, in which an NC (numerically controlled) milling machine is used. As shown in FIG. 5A, a golf club head 1' without the score lines 20 is fixed to the NC milling machine via a jig 2. Note that in this embodiment, a case in which the face 10 is integrally formed with the golf club head is described. However, a face member which forms the face 10 and the head body may be prepared as separate members and joined together. In this case, the face member is fixed to the NC milling machine to form the score lines 20. The NC milling machine includes a spindle 4 which is rotatably driven around the axis Z. A cutting tool (end mill) 5 is attached to the lower end of the spindle 4.

After setting the plane coordinates of the face 10 in the NC milling machine, the spindle 4 is rotatably driven. The face 10 (golf club head 1') or cutting tool 5 is moved relatively in the formation direction of the score lines 20 to cut the face 10 so that grooves without the stair-shaped portions 211 are formed by the first process. Then, the cutting tool 5 is changed as needed and the stair-shaped portions 211 are processed.

FIG. 5B shows an example of a state during processing of the stair-shaped portions 211. FIG. 5B illustrates a case in which the stair-shaped portions 211 are formed one by one for the side walls 21 of a groove 20' formed by the first process. FIG. 5C shows another example of a state during processing of the stair-shaped portions 211. FIG. 5C illustrates a case in which the stair-shaped portions 211 are simultaneously formed in a pair of the side walls 21 of the groove 20' formed by the first process.

Since the stair-shaped portion 211 includes fine depressions and projections, the surface hardness of the face 10 may decrease and the face 10 may be easily worn out. For this reason, it is desirable to perform treatment for increasing the surface hardness of the face 10 after forming the stair-shaped portion 211. This treatment may be performed for the entire face 10, or may be performed only for the vicinities of the stair-shaped portions 211. As such surface treatment, cementing, nitriding, soft nitriding, PVD (Physical Vepor Deposition), ion plating, DLC (Diamond Like Carbon) treatment, plating, or the like is available. Particularly, surface treatment such as cementing or nitriding is preferable which reforms a surface without forming another metal layer on it.

EXAMPLES

Golf club heads of an example of the present invention and two comparative examples were fabricated, and a test for the backspin amount was performed using golf clubs respectively mounted with those golf club heads. FIG. 6 is a table showing the specifications of score lines of Comparative Examples 1 and 2 and the example, the test results, and the conformance to the two-circle rule. All golf club heads of Comparative Examples 1 and 2 and the example were wedges with a loft angle of 58°.

In the golf club head of the example, the stair-shaped portions were formed as shown in FIG. 2. The number of steps of the stair-shaped portion was set to seven and the step difference Sh of each step was set to 20 μm.

Figure 7A:
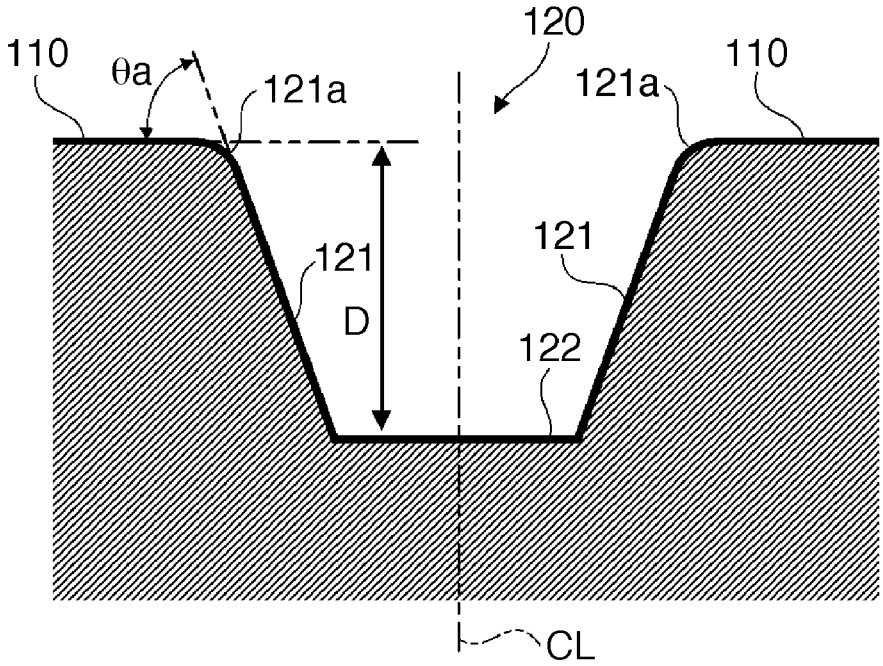
FIG. 7A is a sectional view of a score line 120 of Comparative Example 1.
Figure 7B:
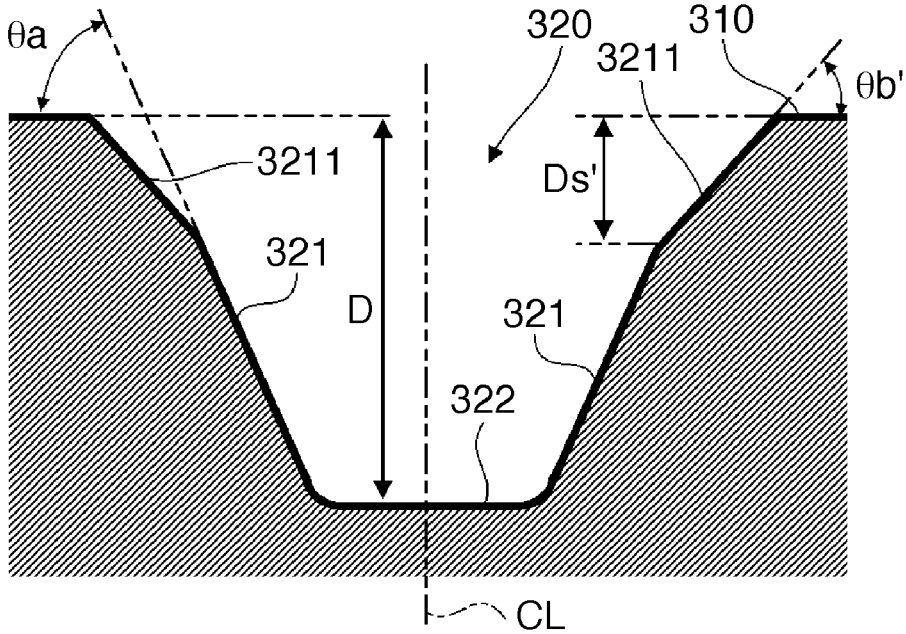
FIG. 7B is a sectional view of a score line 320 of Comparative Example 2.

FIG. 7A shows the cross-sectional shape of a score line 120 of Comparative Example 1, and FIG. 7B shows the cross-sectional shape of a score line 220 of Comparative Example 2.

The score line 120 of Comparative Example 1 has a pair of side walls 121 and a bottom wall 122. The cross-sectional shape of the score line 120 is symmetric with regard to its virtual center line CL. The side walls 121 are formed to be flat, and each of edges 121*a* of the score line 120 is rounded to have a radius of 0.05 mm. A depth D is the length from a face 110 to the bottom wall 122, and an angle θa is the angle between the face 110 and side wall 121.

The score line 320 of Comparative Example 2 has a pair of side walls 321 and a bottom wall 322. The cross-sectional shape of the score line 320 is symmetric with regard to its center line CL. In each of the side walls 321, a flat portion 3211 with an angle of inclination different from that of the side wall 321 is formed in an area Ds' ranging from the face 310 in the depth direction of the score line 320. A depth D is the length from the face 310 to the bottom wall 322. An angle θa is the angle between the face 310 and a portion of the side wall 321 other than the flat portion 3211. An angle θb' is the angle between the face 310 and the flat portion 3211.

In FIG. 6, "angle θa" indicates the angles θa shown in FIGS. 2, 7A, and 7B. "Angle θb" indicates the angle θb shown in FIG. 2, which is the angle between the face 10 and the straight line (L1) passing through each edge (Po) of the stair-shaped portion. That is, the score line of the example has an arrangement in which the edges (Po) of the stair-shaped portion are positioned on the same straight line. "Angle θb'" indicates the angle θb' shown in FIG. 7B.

"Width W" indicates the width of the score line measured based on the 30 degrees measurement rule described above with reference to FIG. 4. "Depth D" indicates the depths D shown in FIGS. 2, 7A, and 7B. "Area Ds" indicates the area Ds shown in FIG. 2, which is the area of the stair-shaped portion in the depth direction of the score line. "Area Ds'" indicates the area Ds' shown in FIG. 7B.

"Pitch P" indicates the arrangement interval of the score lines and is represented by P=W+S using the width of the score line and the distance S between the adjacent score lines measured based on the 30 degrees measurement rule described above with reference to FIG. 4.

As is obvious from FIG. 6, the example and Comparative Example 2 are different only in presence/absence of a stair-shaped portion. The example corresponds to a golf club head obtained by forming stair-shaped portions respectively in the flat portions 3211 of Comparative Example 2.

In FIG. 6, "Conformance to two-circle rule" indicates whether the golf club head conforms to the above-described two-circle rule. "NG" means "not conform" and "OK" means "conform". Only Comparative Example 1 does not conform to the two-circle rule.

A test for the backspin amount was performed by hitting a plurality of golf balls with each of the golf clubs from the fairway and rough, and the backspin amount was actually measured. Of "test results" in FIG. 6, "backspin amount" shows the average values of the actually measured values of backspin amounts obtained from a plurality of shots from the fairway and rough. Letting BSf be the value shown in "backspin amount" in the case of a shot from the fairway and BSr be the value shown in "backspin amount" in case of a shot from the rough, "percentage of decrease" is calculated from the following expression.

$$\text{Percentage of decrease } (\%) = BSr/BSf \times 100 - 100$$

"Percentage of decrease" is an index indicating a degree of decrease in the backspin amount of a shot from the rough with respect to a shot from the fairway. The smaller the absolute value, the smaller a decrease in the backspin amount in the case of a shot from the rough.

From the test results, it is obvious that a decrease in the backspin amount in the case of a shot from the rough is small in the golf club head of the example. Particularly, since Comparative Example 2 and Example 2 are different only in presence/absence of a stair-shaped portion, it is obvious that the stair-shaped portion has an effect of suppressing a significant decrease in the backspin amount of a shot in the case of a shot from the rough.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions. This application claims the benefit of Japanese Patent Application No. 2008-226310, filed Sep. 3, 2008, which is hereby incorporated by reference herein in its entirety.

What is claimed is:

1. A golf club head comprising:

a plurality of score lines on a face, and a stair-shaped portion comprising a plurality of steps arranged on a side wall of said score line in the shape of stairs from a face side end towards a bottom end of the side wall, wherein said side wall includes said stair-shaped portion and a flat portion, said side wall includes one first edge and second edges, said first edge is formed between the face and said stair-shaped portion, each of said second edges is formed by each of said plurality of steps, and at least one of said second edges is not arranged on an extended line of said flat portion.

2. The golf club head according to claim 1, wherein each height of the steps of said stair-shaped portion is not more than 30 μm, the height being measured in a depth direction of score line.

3. The golf club head according to claim 1, wherein an area of said stair-shaped portion in the depth direction of said score line is not more than half of a depth of said score line.

4. The golf club head according to claim 1, wherein a cross section area A (inch$^2$) of said score line, a width W (inch) of said score line measured based on the 30 degrees measurement rule and a distance S (inch) between said score lines adjacent one another satisfy: $A/(W+S) \leqq 0.003$.

5. The golf club head according to claim 4, wherein said stair-shaped portion is formed so that said first and second edges are formed to be positioned within a second virtual circle with a radius of 0.011 inch, the second virtual circle being concentric with a first virtual circle which internally touches said side wall and said face with a radius of 0.010 inch.

6. The golf club head according to claim 1, wherein said stair-shaped portion is formed by a cutting process.

7. The golf club head according to claim 1, wherein said face is processed by a surface treatment for increasing surface hardness thereon.

8. The golf club head according to claim 1, wherein at least some of said plurality of steps are arranged at a constant pitch.

9. The golf club head according to claim 1, wherein the plurality of steps are formed from alternating surfaces generally parallel to said face and generally perpendicular to said face.

10. The golf club head according to claim 1, wherein said second edges are arranged on a straight line, and said extended line and said straight line cross each other.

11. The golf club head according to claim 10, wherein an angle θa between said extended line and said face and an angle θb between said straight line and said face satisfy θa>θb.

12. The golf club head according to claim 1, wherein said second edges are not arranged on a straight line.

* * * * *